US005560177A

United States Patent [19]

Brightwell

[11] Patent Number: 5,560,177

[45] Date of Patent: Oct. 1, 1996

[54] TRIMMABLE OPEN WEB JOIST

[76] Inventor: Lionel L. Brightwell, 1697 E. Braemere Rd., Boise, Id. 83702

[21] Appl. No.: 610,724

[22] Filed: Mar. 4, 1996

[51] Int. Cl.[6] ..... E04C 3/12

[52] U.S. Cl. ..... 52/729.4; 52/730.7; 52/730.1; 52/690; 52/693

[58] Field of Search ..... 52/729.4, 729.2, 52/729.1, 730.7, 730.1, 690, 693, 694

[56] References Cited

U.S. PATENT DOCUMENTS

| | | | |
|---|---|---|---|
| 2,169,253 | 8/1939 | Kotrbaty | 52/729.2 X |
| 3,490,188 | 1/1970 | Troutner | 52/730.7 X |
| 3,651,612 | 3/1972 | Schmitt | 52/693 |
| 4,207,719 | 6/1980 | Knowles | 52/693 |
| 4,228,631 | 10/1980 | Geffe | 52/690 |
| 4,501,102 | 2/1985 | Knowles | 52/690 |
| 4,525,974 | 7/1985 | Steiedle-Sailer et al. | 52/729.4 X |
| 4,852,322 | 8/1989 | McDermid | 52/729.4 X |
| 4,862,662 | 9/1989 | Eberle et al. | 52/729.4 X |

*Primary Examiner*—Robert Canfield
*Attorney, Agent, or Firm*—Joseph W. Holland

[57] ABSTRACT

An improved open web structural support member having a trimmable solid web end subassembly. The solid web subassembly has an upper sub-chord having a groove in the bottom face thereof, a bottom sub-chord, having a groove in the upper face thereof, a solid web end member sized and configured to fit in the grooves provided in the upper and lower sub-chord members, the solid web end member being glued along the edges in those sub-chord members. The included angle formed between the inner edge of the solid web end member and the upper edge of the solid web end member equals an obtuse angle. The solid web end subassembly is positioned and secured between the upper and lower chord members.

15 Claims, 2 Drawing Sheets

TRIMMABLE OPEN WEB JOIST

BACKGROUND OF THE INVENTION

1. Technical Field

This invention relates to an open web truss-type structural supports, and more specifically to an open web truss-type structural supports which is trimmable in length.

2. Background

A problem which frequently occurs on construction job sites is faced when joists or trusses are set in place. Oftentimes, the dimensions between the structural components which will bear the joists or trusses vary in their as-built dimension as opposed to the designed dimensions. Oftentimes, this variance may be measured simply as a matter of inches or fractions of inches. Nevertheless, this condition could lead to a situation where costly prefabricated materials would have to be discarded and refabricated.

A number of approaches have been taken to solve this problem. In Black, U.S. Pat. No. 3,078,970, a truss is disclosed which allows for longitudinal adjustment by means of a series of corresponding and overlapping holes located along the top and bottom chord members which may be selectively bolted together to adjust the overall length of the truss.

In Reetz, U.S. Pat. No. 4,745,724, a support member of adjustable length is disclosed. The means for adjusting the length of the member includes an adjustable length end web, pivotally attached at one end to the lower chord member and at the second end to a mounting bracket. The mounting bracket in turn is adjustably attachable to the upper chord member.

Black and Reetz address the problem of adjustability of structural members which are unique in the sense that they both deal with structural members which are prefabricated using metal structural components. Other solutions to the problem have been suggested by prefabricators of wooden structural components.

Open Joist Inc. of Brossard, Quebec, Canada, and Plattsburg, N.Y., produces an open web joist assembled of lumber and glue. The ends of the open web joists provide a solid web which spans between the upper and lower chord members, the edge portion of the solid web being butted up against the upper and lower chord members and glued to the upper and lower chord members, providing a length at either end of the joist which may be trimmed for length adjustment.

Similarly, Trim Joist of Columbus, Mo., fabricates an open web joist having a solid web end section glued in to a pair of grooves, one groove located on the lower face of the upper chord member and a second groove being located on the upper face of the lower chord member. The Trim Joist product design provides a series of inclined web members with the web member located at either end of the joist being positioned in the vertical or upright position, normal to the upper and lower chords.

Yet another product on the market is manufactured by a company known as Trus Joist Corporation, which provides a continuous, oriented strand board, or O.S.B., web where the top and bottom edges of the web are glued into a pair of grooves, one groove located on the bottom side of the upper chord member and a second groove located on the top side of the bottom chord member respectively. See Brightwell, U.S. Pat. No. 4,715,162, Wooden Joist With Web Members Having Cut Tapered Edges and Vent Slots.

Each of the above described lumber or wood product joists share one distinct disadvantage, that being that the prefabricated structural component must be fabricated in a relatively large facility in order to be capable of accommodating a prefabricated structural component, often times in excess of 30 feet in length. Because these structural components are prefabricated entirely or in part by gluing, the fabrication facility must maintain, at substantial cost, temperature and humidity controls in order to meet the strict quality control criteria required for these processes.

Therefore, one object of the present invention is to provide a design for a trimmable structural support member which allows the greatest portion of the structural support member to be prefabricated at a facility where the need for temperature and moisture control is eliminated.

Another object of the present invention is to provide a design which allows for the prefabrication of joist end subassemblies which would be readily insertable between the upper chord member and lower chord member of a conventional wood joist, thereby minimizing the cost of maintaining the facility in which the end sections are prefabricated while allowing for the conversion of a standard open web truss-type joist to an adjustable or trimmable joist.

Another disadvantage of previous wood product and lumber designs which employ a glued in solid web end section is found in the fact that oftentimes the glue joint, where the web is glued to a chord member, exhibits a propensity for "unzipping" or failing along the glue joint when the joist is placed under load.

Therefore, a third object of the present design is to minimize stress risers, or stress concentrations, which exist in trimmable open web truss-type joists at either end of the glue joint which secures the solid web section to the chord members.

SUMMARY OF THE INVENTION

According to the present invention, these and other objects are achieved by an open web trimmable joist having a solid web end subassembly. The open web joist comprises an upper chord member and a lower chord member connected by a series of inclined web members, the inclined web members being connected to the upper and lower chord members by metal plate fasteners configured having a plurality of gang nails projecting from one face for attachment to the chord member and the inclined web members. According to the invention, the series of inclined web members terminates with the tension or upper end of an inclined web member being closest to an end of the trimmable open web joist. The preferred embodiment of the invention has an insertable end section comprising an upper sub-chord member, having a groove in the bottom face thereof, a lower sub-chord member, having a groove in the top face thereof, a solid web end member having upper and lower edges which are sized and configured to fit in the grooves provided in the upper and lower sub-chord members, the solid web end member being glued along its edges into the sub-chord assembly upper and lower grooves. The included angle formed between the inner edge of the solid web end member and the upper edge of the solid web end member equals the included angle formed between the terminal inclined web member and the upper chord member, which in all cases equals some angle greater than ninety degrees. The solid web end subassembly is positioned between the upper and lower chord members and fastened by a means which would not impede or damage the tools which are used to trim the end of the joist.

This design is such that the included angle formed between the inner edge of the solid web end member and the upper edge of the solid web end member produces a smooth transition from the solid web end portion of the truss to the open web portion of the truss thereby minimizing the stress riser which exists in solid web type trusses and trimmable open web truss-type joists at the joint where the solid web section is glued to the chord member. The solid web end section of a trimmable open web truss-type joist behaves like a beam which exhibits a flexural stress. This beam-like characteristic changes where the solid web end section transitions to an open web truss member which is characterized by axial stresses exhibiting a series of tensile and compressive forces within each web member which cancel each other out. With an open or obtuse angle of the solid web located to the compression side of the joist, that is, located at the top of an inclined web member, the connecting couple is resolved by a series of forces that produce a secondary compression stress perpendicular to the line along which the web is glued into the upper sub-chord. A different arrangement, as seen in the prior art, creates a stress riser or stress concentration at the point of termination of the glue joint which may cause the glue joint, to "unzip" due to a combined tension and shear force perpendicular to the joint.

Additionally, the design of the present invention optimizes plate sizes and web length due to the compression side stresses being partially transferred by bearing perpendicular to the grain on the face of the first inclined tension web, thereby requiring a shorter plate for gripping purposes than is required on the tension side. Because the tension or lower plate is located at a greater distance from the end support or trimmable end than the compression or upper plate, the tension plate can be longer than the compression plate without requiring a longer web section to produce the same amount of trimmable length.

In the preferred embodiment of the invention, a single end of an open web truss is fabricated employing the solid web end subassembly described herein. The second end is fabricated employing designs well known to those skilled in the art.

In an alternative embodiment of the invention, the trimmable open web joist comprises an open web section having a solid web end member at either of its two ends. In the alternative embodiment, the solid web end members are not prefabricated as subassemblies but rather are fabricated by milling grooves in each end of upper chord and the lower chord members, the grooves extending from either end of the chord member toward the mid-point of the chord, and gluing a solid web end member into each of the two ends. While this alternative embodiment does not take advantage of one of the objects of the present invention it still realizes the advantage of a terminal web member which are configured so that the series of inclined web members terminates with the tension or upper end of an of inclined web member being closest to the end of trimmable open web joist. This allows the included angle formed at the intersection of upper edge of the solid web end member and the inner edge of the solid web end member to equal some angle greater than 90° thereby producing a smooth transition from the solid web end portion of the truss to the open web portion of the truss.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
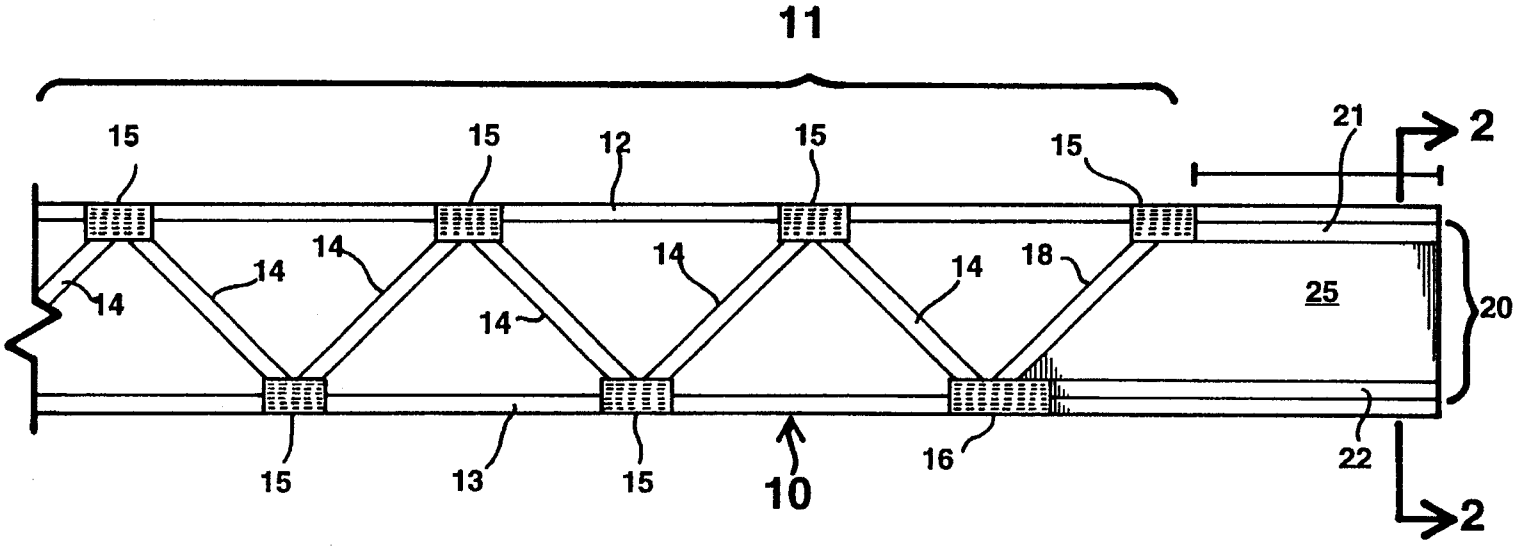
FIG. 1 is a side view of the improved trimmable open web joist.
Figure 2:
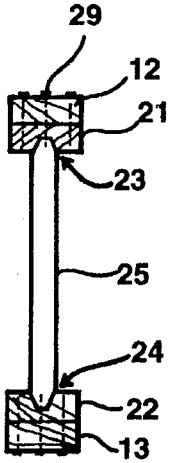
FIG. 2 is an end view of the improved trimmable open web joist.
Figure 3:
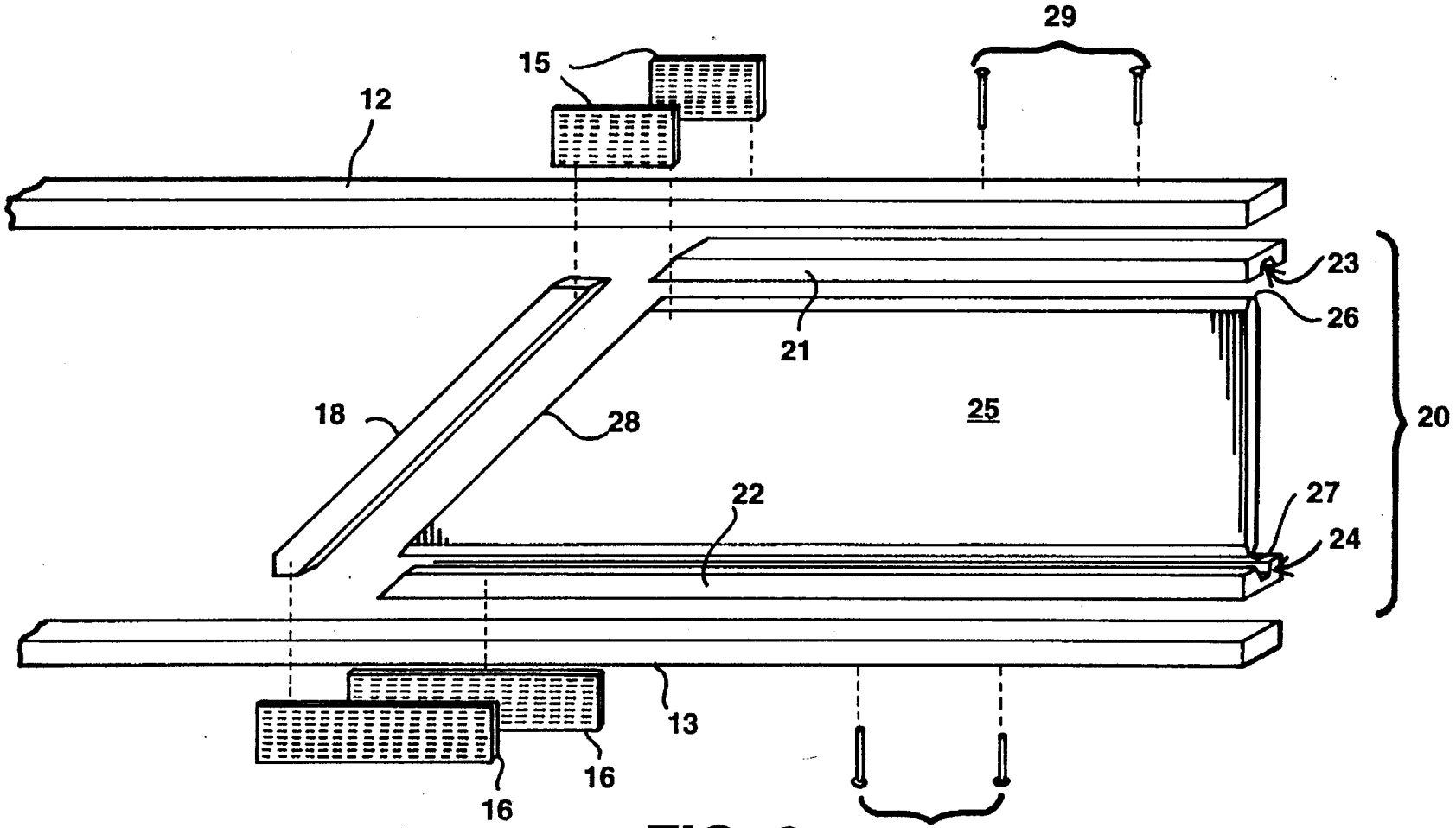
FIG. 3 is an exploded perspective representational view of the improved trimmable open web joist.

Referring now to FIGS. 1 through 3, the advantages of the present invention will be more fully appreciated. In the preferred embodiment, trimmable open web joist 10 comprises open web section 11 and solid web end subassembly 20. Open web section 11 comprises upper chord member 12 and lower chord member 13 connected by a series of inclined web members 14. Located at either end of the series of inclined web members 14 is a terminal web member 18. Terminal web members 18 are configured so that the series of inclined web members 14 terminates with the tension or upper end of an inclined web member being closest to an end of trimmable open web joist 10. In the preferred embodiment upper chord members 12, lower chord members 13, inclined web members 14 and terminal web members 18 are fabricated from common dimensional lumber, typically, two-by-fours. Inclined web members 14 are connected to upper chord member 12 and lower chord member 13 by metal plate fasteners 15. Terminal web members 18 are connected to upper chord member 12 and lower chord member 13 by upper terminal metal plate fastener 17, and lower terminal metal plate fastener 16. All metal plate fasteners are formed by stamping in a punch or press so that one face has a plurality of pointed gang nails protruding therefrom. All metal plate fasteners are fastened to open web section 11 by rolling open web section 11 through a set of rolls or a metal plate press.

Lower terminal metal plate fastener 16 is located at a greater distance from the trimmable end than the upper terminal metal plate fastener 17, and is therefore longer.

Solid web end subassembly 20 comprises upper sub-chord member 21 and lower sub-chord member 22. In the preferred embodiment, upper sub-chord member 21 and lower sub-chord member 22 are fabricated from common dimensional lumber, typically two-by-fours. Upper sub-chord member 21 has groove 23 located in the lower face thereof. Similarly, lower sub-chord member 22, has groove 24 located in its upper face. Solid web end member 25 has upper edge 26 and lower edge 27 which are sized appropriately to fit and are glued into upper groove 23 located in the bottom face of upper sub-chord member 21 and lower groove 24 located in the upper face of lower sub-chord member 22 respectively. Solid web end member 25 is further configured such the angle formed at the intersection of upper edge 26 and inner edge 28 equals the angle formed at the intersection of upper chord member 12 and terminal inclined web member 18, this angle being an obtuse angle. In the preferred embodiment, solid web end member 25 is fabricated from oriented strand board and the adhesive used to join upper edge 26 and lower edge 27 of solid web end member 25 into upper groove 23 and lower groove 24 respectively is phenol-resorcinol, although other materials such as plywood may be used for the web and other adhesives known to those practiced within the art may be used to provide adequate joints.

Solid web end subassembly 20 is positioned between upper chord member 12 and lower chord member 13 and fastened by a means which would not impede or damage tools which are used to trim the end of the joist. This means could include an adhesive, however, in the preferred embodiment, solid web end subassembly 20 is fastened between upper chord member 12 and lower chord member 13 by aluminum nails 29. Upper terminal metal plate fastener 17 and lower terminal metal plate fastener 16 also secure solid web end subassembly 20 between upper chord member 12 and lower chord member 13.

Open web section 11 can be readily prefabricated in any conditions including outdoors where temperature and humidity are totally unregulated. Meanwhile, solid web end subassembly 20 is prefabricated in a controlled environment, however, because of the limited length of the subassembly, the typical length being less than three feet, the facility required for prefabrication may be of minimal size thereby substantially reducing the overhead costs associated with maintaining such facility. Once solid web subassemblies 20 are prefabricated they may be installed in open web sections 11 at the site of prefabrication.

While there is shown and described the preferred embodiment of the invention, it is to be distinctly understood that this invention is not limited thereto but may be variously embodied to practice within the scope of the following claims.

I claim:

1. A trimmable open web structural support apparatus having first and second ends comprising:

an upper chord member having a midpoint and two ends;

a lower chord member having a midpoint and two ends;

a plurality of inclined web members interconnecting said upper chord member and said lower chord member;

means for connecting said inclined web members to the upper chord member and the lower chord member;

a solid web end subassembly having an upper sub-chord member having a longitudinal axis an upper and a lower face, the upper sub-chord member lower face configured having a groove parallel to the longitudinal axis of the upper sub-chord member, a lower sub-chord member having a longitudinal axis an upper and a lower face, the lower sub-chord member upper face configured having a groove parallel to the longitudinal axis of the lower sub-chord member and a solid web end member having an upper edge, a lower edge, an inner edge and an outer edge, the solid web end member upper edge being secured between the upper sub-chord member lower face groove by an adhesive means and the solid web end member lower edge being secured between the lower sub-chord member upper face groove by an adhesive means; and means for securing the solid web end subassembly between the upper chord member and the lower chord member so that the outer edge of the solid web end member extends along substantially the same plane as a first end of the upper chord member and a first end of the lower chord member.

2. The structural support apparatus of claim 1 further comprising a pair of solid web end subassemblies, one solid web end subassembly located at either end of the trimmable open web structural support apparatus.

3. The structural support apparatus of claim 1 wherein the plurality of inclined web members interconnecting said upper chord member and said lower chord member are configured so that the plurality of spaced apart inclined web members terminates with a terminal web member having an upper tension end of the terminal web member closest to the end of trimmable open web joist.

4. The structural support apparatus of claim 3 wherein the solid web end subassembly further comprises an included angle formed between the inner edge of the solid web end member and the upper edge of the solid web end member which equals the included angle formed between the terminal web member and the upper chord member.

5. The structural support apparatus of claim 4 wherein the included angle formed between the inner edge of the solid web end member and the upper edge of the solid web end member is an obtuse angle.

6. The structural support apparatus of claim 1 wherein the means for securing the solid web end subassembly between the upper chord member and the lower chord member further comprises aluminum nails.

7. An improved trimmable open web structural support apparatus having first and second ends, an open web, an upper chord member, a lower chord member, a plurality of inclined web members interconnecting the upper chord member and the lower chord member and means for connecting the inclined web members to the upper chord member and the lower chord, the improvement comprising:

at least one solid web end subassembly having an upper sub-chord member having a longitudinal axis an upper and a lower face, the upper sub-chord member lower face configured having a groove parallel to the longitudinal axis of the upper sub-chord member, a lower sub-chord member having a longitudinal axis an upper and a lower face, the lower sub-chord member upper face configured having a groove parallel to the longitudinal axis of the lower sub-chord member and a solid web end member having an upper edge, a lower edge, an inner edge and an outer edge, the solid web end member upper edge being secured between the upper sub-chord member lower face groove by an adhesive means and the solid web end member lower edge being secured between the lower sub-chord member upper face groove by an adhesive means; and means for securing the solid web end subassembly between the upper chord member and the lower chord member.

8. The improved structural support apparatus of claim 7 further comprising a pair of solid web end subassemblies, one solid web end subassembly located at either end of the trimmable open web structural support apparatus.

9. The improved structural support apparatus of claim 7 wherein the plurality of inclined web members interconnecting said upper chord member and said lower chord member are configured so that the plurality of spaced apart inclined web members terminates with a terminal web member having an upper tension end of the terminal web member closest to an end of trimmable open web joist.

10. The improved structural support apparatus of claim 9 wherein the solid web end subassembly further comprises an included angle formed between the inner edge of the solid web end member and the upper edge of the solid web end member which equals the included angle formed between the terminal web member and the upper chord member.

11. The improved structural support apparatus of claim 10 wherein the included angle formed between the inner edge of the solid web end member and the upper edge of the solid web end member is an obtuse angle.

12. The improved structural support apparatus of claim 7 wherein the means for securing the solid web end subassembly between the upper chord member and the lower chord member further comprises aluminum nails.

13. A trimmable open web structural support apparatus having first and second ends comprising:

an upper chord member having a midpoint, two ends a longitudinal axis an upper and a lower face, the upper chord member lower face configured having a groove parallel to the longitudinal axis of the upper chord member;

a lower chord member having a midpoint, two ends, a longitudinal axis an upper and a lower face, the lower chord member upper face configured having a groove parallel to the longitudinal axis of the lower chord member;

a plurality of inclined web members interconnecting said upper chord member and said lower chord member, said plurality of inclined web members being configured so as to terminate with a terminal web member having an upper tension end of the terminal web member closest to an end of the trimmable open web joist;

means for connecting said inclined web members to the upper chord member and the lower chord member; and at least one solid web end member having an upper edge, a lower edge and an inner edge and an outer edge, the outer edge of the solid web end member extending along substantially the same plane as a first end of the upper chord member and the first end of the lower chord member, the solid web end member upper edge being secured in the upper chord member lower face groove by an adhesive means and the solid web end member lower edge being secured in the lower chord member upper face groove by an adhesive means, the at least one solid web end member further comprising an included angle formed between the inner edge of the solid web end member and the upper edge of the solid web end member which equals an included angle formed between the terminal web member and the upper chord member.

14. The structural support apparatus of claim 13 wherein the included angle formed between the inner edge of the solid web end member and the upper edge of the solid web end member is an obtuse angle.

15. The structural support apparatus of claim 13 further comprising a pair of solid web end members, one solid web end member located at either end of the trimmable open web structural support apparatus.

* * * * *